United States Patent [19]

Takahashi et al.

[11] 4,232,438

[45] Nov. 11, 1980

[54] METHOD AND APPARATUS FOR PROVIDING SPACE SECTIONS IN A CONTINUOUS SLIDE FASTENER CHAIN

[75] Inventors: Kihei Takahashi, Uozu; Toyoo Morita, Kurobe, both of Japan

[73] Assignee: Yoshida Kogyo K.K., Japan

[21] Appl. No.: 964,461

[22] Filed: Nov. 29, 1978

[30] Foreign Application Priority Data

Dec. 7, 1977 [JP] Japan ..... 52-146903

[51] Int. Cl.[3] ..... B23P 19/00

[52] U.S. Cl. ..... 29/408; 29/770

[58] Field of Search ..... 29/33.2, 408, 766, 770

[56] References Cited

U.S. PATENT DOCUMENTS

| | | | |
|---|---|---|---|
| 3,225,430 | 12/1965 | Fasciano | 29/766 |
| 3,391,441 | 7/1968 | Carlie | 29/766 |
| 3,812,573 | 5/1974 | Fukuroi | 29/770 |
| 3,863,323 | 2/1975 | Takamatsu | 29/770 |

*Primary Examiner*—Lowell A. Larson

*Attorney, Agent, or Firm*—Hill, Van Santen, Steadman, Chiara & Simpson

[57] ABSTRACT

A method and apparatus proposed for removing interlocking elements over a certain longitudinal area from a continuous slide fastener chain of the plastic filament coil type, and providing interlocking element-free space sections in the fastener chain, according to which the fastener chain is put on a die having a square recess in its surface, a punch having a cutter blade on its lower end is moved down to and press the fastener chain into the recess, whereby the filament coils are made to bend in the V-shape in the recess, the punch is further lowered to cut off the leg portions of the coils, allowing the head portions to remain exposed and raised above the surface of the fastener chain. The raised head portions can then easily and efficiently be removed by a picking-up means, such as a scraper.

4 Claims, 12 Drawing Figures

METHOD AND APPARATUS FOR PROVIDING SPACE SECTIONS IN A CONTINUOUS SLIDE FASTENER CHAIN

BACKGROUND OF THE INVENTION

The present invention relates to a method and an apparatus for, as one process of manufacturing individual zippers or slide fasteners formed of a fastener chain comprising a pair of opposed tapes carring interlocking teeth or elements of plastic filament coils, removing a certain length of the interlocking teeth from the slide fastener chain, whereby a sequence of the "space sections" which are devoid of the interlocking teeth are provided at predetermined intervals in a lengthy continuous slide fastener chain.

In order to simplify and facilitate the assembling and finishing of zipper fasteners, it nowadays is a common practice of the manufacturers to work on a single, continuous slide fastener chain consisting of a pair of opposed stringer tapes carrying thereon uninterrupted rows of continuous interlocking elements, rather than on separate, individual fastener chains, and then to provide element-free sections or the so-called "space sections" in the continuous fastener chain at predetermined intervals for mounting sliders and end stops and thereafter to cut the thus treated length of the chain at each space section to produce the individual zipper fasteners.

In the manufacture of the slide fasteners of the coiled plastic filament type having a lengthy, continuous slide fastener chain, there have been proposed various methods and apparatuses, in particular, for removing a certain length of interlocking elements from the slide fastener chain. However, none of them have been found completely satisfactory, since the removal had to be conducted only by excessive force and tended to injure the fabric tape to which the interlocking elements are attached.

The removal of the interlocking elements in accordance with the prior art techniques was conducted by a combination of at least four steps as follows: (a) step of securedly supporting the fastener chain in a position where cutting step (c) is to be carried out, (b) step of exposing the head portions of the interlocking elements out of the opposing edges of the carrier tapes to an extent at least that the carrier tapes should not be impaired by cutting in the subsequent cutting step, (c) step of cutting off the exposed head portions by means of a cutter or a punch, and (d) step of removing the leg portions of the interlocking elements or the element debris by pulling out of the sewing threads. (See, for example, U.S. Pat. No. 3,852,869.)

The above-mentioned four steps have had to be carried out one by one, each after completion of the preceding step, resulting in low working efficiency, and the apparatus used was an assemblage of individual parts functioning for each of the steps, whereby the apparatus has no more been simplified.

SUMMARY OF THE INVENTION

It is therefore an object of the present invention to provide a method for providing space sections in a slide fastener chain in which the working efficiency is much enhanced owing to the ingenious combination of the process steps.

Another object of the present invention is to provide an apparatus for effectively carrying out the above method thereby to combine each process step in a quicker succession and shorten the whole processes.

The method of the present invention comprises the steps of (a) holding the slide fastener chain, (b) lowering a punch having a cutter blade towards the head portions of the interlocking elements of the thus-held slide fastener chain, whereby the interlocking elements become inclined while the head portions become exposed, (c) cutting off the head portions of the elements by the cutter blade while the interlocking elements are kept in the inclined position, and (d) removing the leg portions of the interlocking elements while the elements still remain in the inclined position.

The apparatus useful for the above method comprises (1) a die facing a punch having a cutter blade and provided with a recess smaller in width than the interlocking elements of the slide fastener chain into which the head portions of the interlocking elements sink as inclined due to the downward pressing of the punch, (2) a guide member above the die, supported by a guide holder to hold the interlocking elements together with the die underneath and capable of moving along the interlocking elements, (3) a scraper positioned above the die to pick off the leg portions of the interlocking elements after the head portions of the interlocking elements have been cut off by the cutter blade of the punch, while the punch is staying at its lowermost position, and (4) a means for moving the guide member and the scraper in a synchronized motion when the punch is at the lowermost position.

BRIEF DESCRIPTION OF THE DRAWINGS

FIGS. 5 through 11 illustrate the operation of the apparatus of FIGS. 1 to 4 for providing a space section in a slide fastener chain according to the present invention, in which:

FIG. 5 is a cross-section showing the condition of the slide fastener chain as placed on a die;

FIG. 6 is a cross-section showing the condition of the interlocking elements as inclined by the downward force of a lowering punch;

FIG. 7 is a cross-section on line IV—IV of FIG. 6 in the direction shown by the arrows;

FIG. 8 is a cross-section showing the condition under which the interlocking head portions have been cut off by means of the punch at its lowermost position;

FIG. 9 is a cross-section on line V—V of FIG. 8 in the direction shown by the arrows;

FIG. 10 is a plan view showing the removal of the leg portions by means of a scraper; and FIG. 11 is a cross-sectional view of FIG. 10.

DETAILED DESCRIPTION OF THE PREFERRED EMBODIMENTS

A preferred method and the preferred apparatus of the present invention will now be described by way of example with reference to the drawings.

Figure 12:
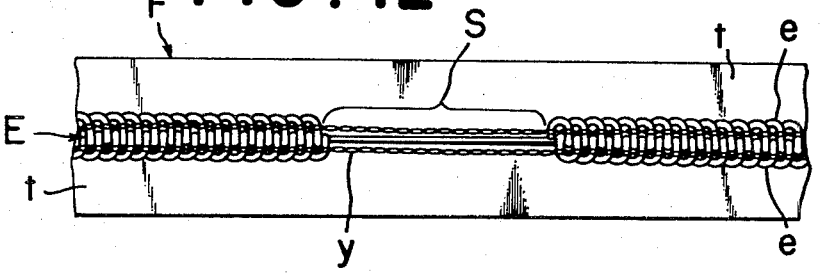
FIG. 12 is a plan view of a finished slide fastener chain which has been provided with a space section.

Referring to FIG. 12, a finished slide fastener chain F is provided a space section S, and rows of continuous interlocking fastener elements E consisting of coiled plastic filaments e in interlocked conditions join a pair of tapes t, t together, to each of which tapes a row of the fastener elements E is attached and secured by yarns y sewn in.

Figure 5:
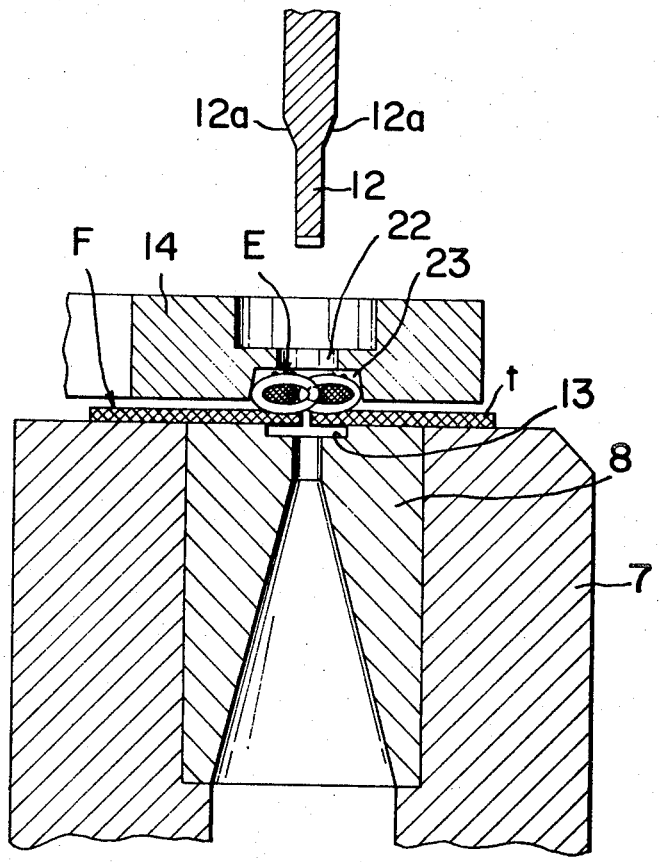
Figure 6:
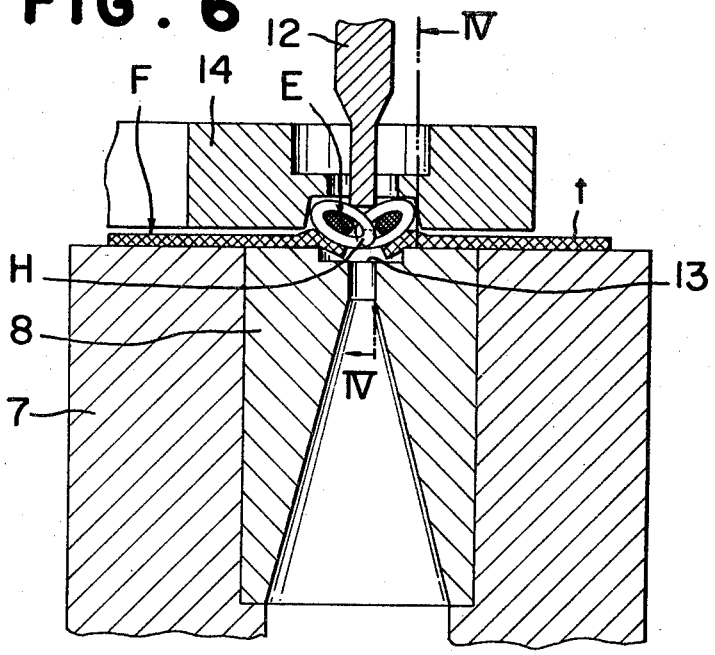

By way of a general illustration as to the provision of a space section in the slide fastener chain F in accordance with the preferred method of the present invention, the interlocking elements E placed on a die (see FIG. 5) become downwardly bent in a V-shaped cross-section around the head portion H when a punch, which is provided with a cutter blade at its lower end, is lowered and contacted with the head portion H (see FIG. 6). Then the interlocking elements E at the portion H are cut off by the cutter blade of the punch leaving leg portion L uncut in situ, as it is further lowered and makes a gap between the tapes t, t (see FIG. 8). Thereafter, the remaining leg portion L of the interlocking elements are removed by means of a scraper to form a length of the space section S as shown in FIG. 12.

Figure 8:
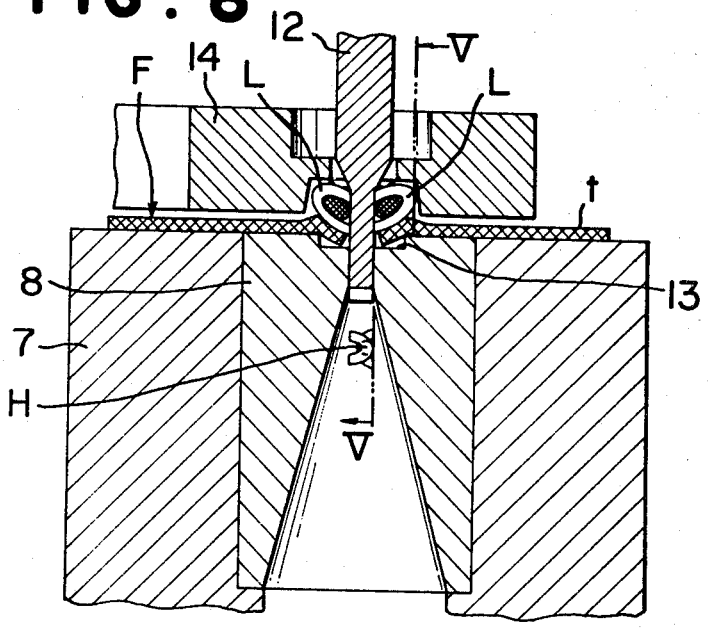

The removal of the leg portion L, in principle, is carried out by releasing it from the yarn y which have been sewn into the tapes t, t to secure the interlocking elements. Such removal, according to the preferred method of the present invention, is much facilitated by use of a scraper, while the lowering punch is kept at its lowermost position and the leg portion L remains in a raised position above the surface of the tapes t, t as shown in FIG. 8.

Figure 3:
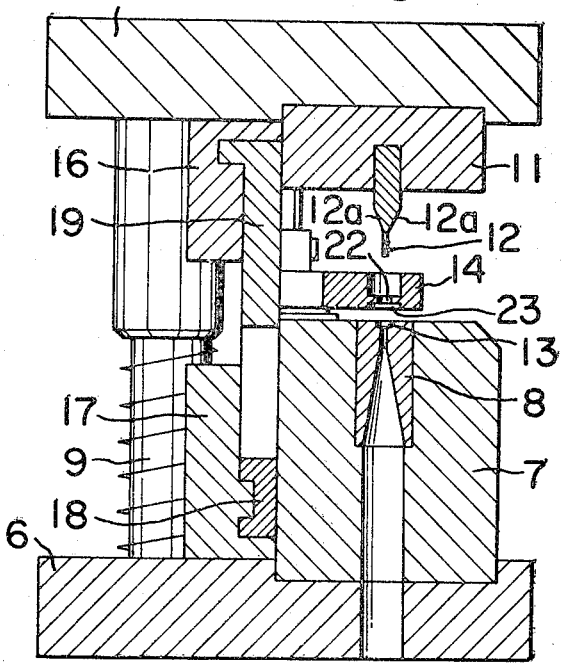
FIG. 3 is a cross-sectional view on line II—II of FIG. 1 in the direction shown by the arrows.

The slide fastener chain F is held between a guide member 14 and die 8 embedded and fixed in a die holder 7 on a base 6 as shown in FIG. 3. Facing the die 8 is provided a punch 12 having a cutter blade at its end. The punch 12 is vertically secured by a holder 11 which is fixed to a movable bench 10. The bench 10 moves up and down along a pair of guide pins 9, 9 erected on the base 6. As shown in FIG. 5, a groove-like recess 13 smaller in width than the interlocking elements E is formed in the upper surface of the die 8. As the punch 12 is lowered and its cutter blade end comes to touch and press the interlocking elements E at the head portions H, part of the slide fastener F including the interlocking elements E is bended and pushed into the recess 13 as shown in FIG. 6. As the punch 12 is further lowered, the head portions H of the slide fastener F are cut off as shown in FIG. 8. The guide member 14 serves to hold the slide fastener chain F in cooperation with the die 8 which is located underneath, and moves along the row of the interlocking elements E in a synchronized motion with a scraper 15 so as to pick the leg portions L after the interlocking head portions H have been cut off.

Figure 1:
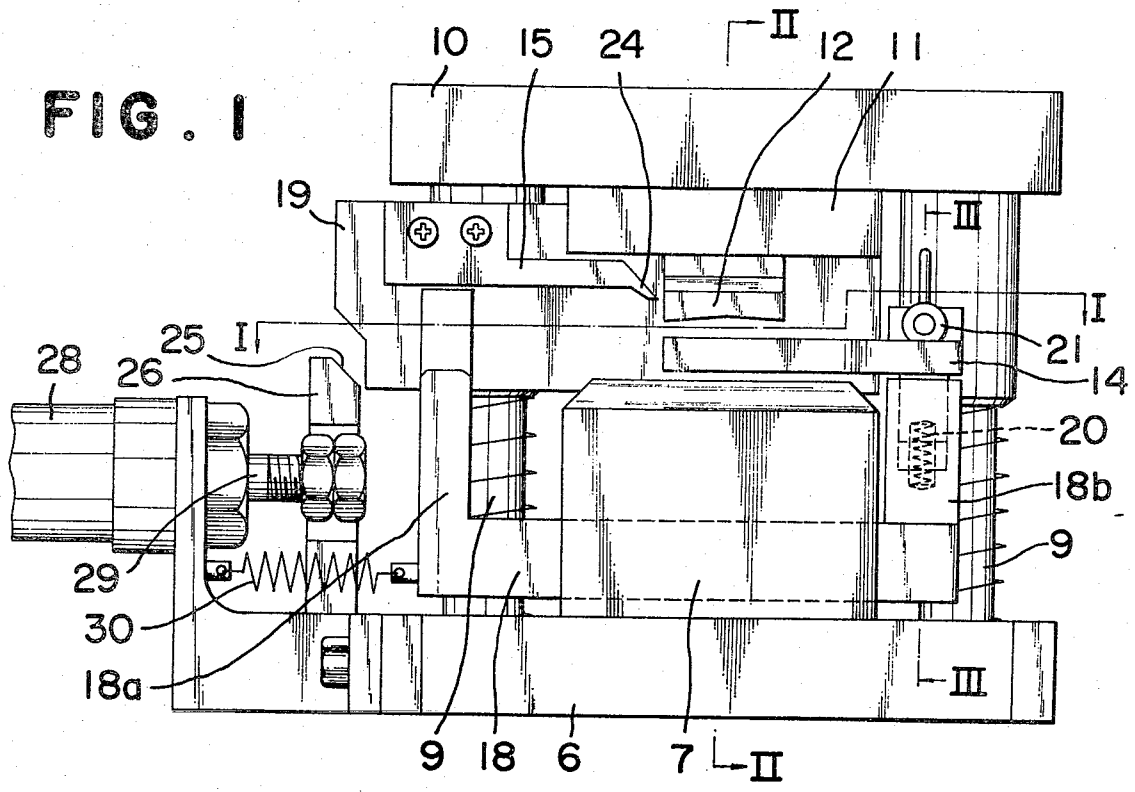
FIG. 1 is a side view of a preferred apparatus according to the present invention.

The construction and movements of the guide member 14 and the scraper 15 are illustrated as follows. The base 6 and the movable bench 10 are provided with supports 17 and 16, respectively. The support 17 on the base 6 is engaged with the guide holder 18 which has a notched cross-section as shown in FIG. 3 and erections 18*a*, 18*b* at both ends thereof as shown in FIG. 1. The guide holder 18 is capable of sliding in the direction parallel to the cutter blade of the punch 12 as guided by the support 17 interengaged therewith. On the other hand, a belt-like scraper holder 19 is engaged to the support 16 fixed to the movable bench 10, whereby the scraper holder 19 slides together with the guide holder 18, since the scraper holder 19 is also engaged with the guide holder 18 at the erection 18*a* in an adjustable depth. The guide member 14 is connected to the guide holder 18 at the erection 18*b* with free up-and-down movements, but always pushed upwardly by a spring 20.

Figure 2:
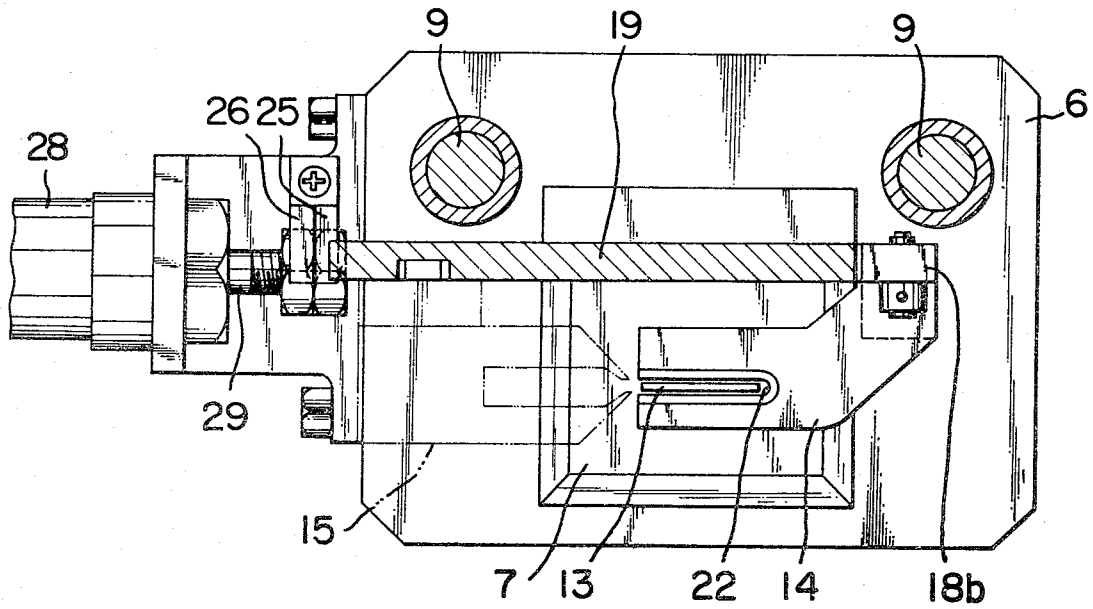
FIG. 2 is a cross-sectional view on line I—I of FIG. 1 in the direction shown by the arrows.
Figure 4:
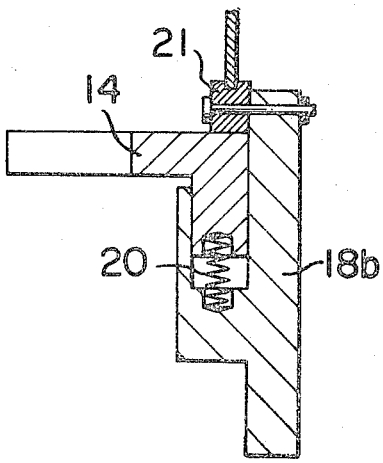
FIG. 4 is a cross-sectional view on line III—III of FIG. 1 in the direction shown by the arrows.

The upper surface of the guide member 14 is in press-contact with a vertical adjustment cam 21 which is a disc having a periphery partially trimmed or a disc rotating eccentrically, whereby the guide member 14 can be moved downwardly against the pushing force of the spring 20 by the rotation of the vertical adjustment cam 21 as shown in FIG. 4. The guide member 14 is in the form of a bar extending over the die 8 and provided with a notch or aperture 22 at the end thereof above the die 8 as shown in FIG. 2. The punch 12 moves up and down through the aperture 22. The guide member 14 is also provided with a groove 23 in the lower surface thereof running in the direction of and having a width fitted to the row of the interlocking elements E. The cross section of the groove 23 has a trapezoidal shape which is wider in the bottom than in the upper, whereby the interlocking elements E can be fixed always at the right position with the centre line of the interlocking elements E coplanar vertically with the center line of the die 8 when the slide fastener chain F is held between the die 8 and the guide member 14, and further when the interlocking elements E are in an inclined position by being pressed downwardly by the cutter blade of the punch 12 as shown in FIG. 6.

The scraper 15, which is shaped like a fork having a pair of claws 24 pointing to a downward direction aslant, is fixed to the scraper holder 19. Within the track through which the lower end of the scraper holder 19 moves up and down is provided an inclination cam 26 which protrudes from the base 6 with its sloping surface 25 facing (in the rightward direction in FIG. 1) the rear end of the descending scraper holder 19.

Figure 9:
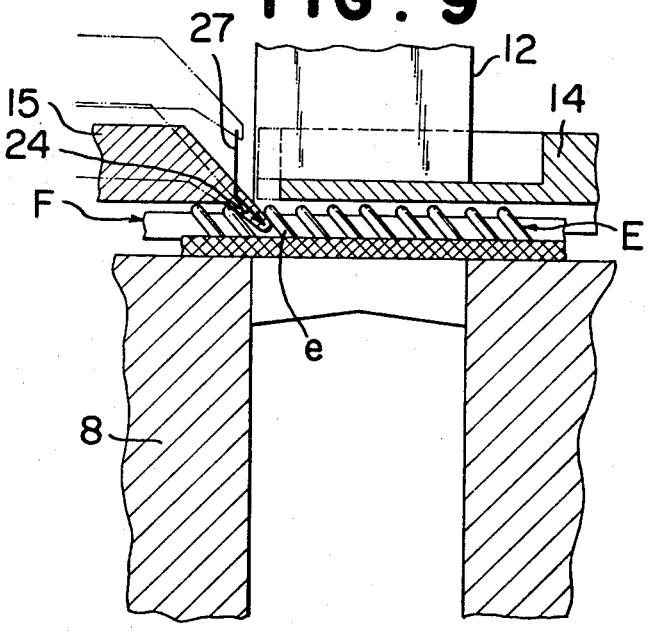
Figure 10:
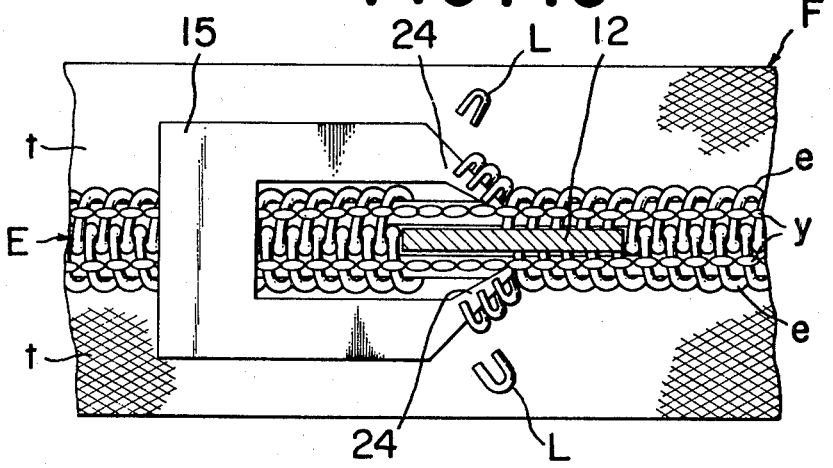

The sloping surface 25 of the inclination cam 26 is inclined at the same angle as the individual filaments e of the interlocking elements E, while the tip of each scraper claw 24 is large enough to enter between the filaments e at a similar angle, as shown in FIG. 9.

The mechanisms of the forward movement of the guide holder 18 and the scraper holder 19 in association with each other are as follows. A cylinder 28 is fixed on the base 6 with its piston rod 29 facing the guide holder 18 to the forward direction, while the guide holder 18 is always pulled to the rearward direction with a spring 30 connected to the base 6 to return to the rearmost position. On the other hand, the scraper holder 19 moves up and down with the punch holder 11. When the punch 12 has reached its lowermost position, the scraper holder 19 is pushed forwardly by the piston rod 29, while the scraper holder 19 is engaged with the guide holder 18 at the erection of the guide holder 18*a* in a sliding movement relative to the punch holder 11. As shown in FIG. 9, the distance between the tips of the claws 24 of the scraper 15 and the guide member 14 is somewhat smaller than the pitch of the individual elements e. Further, the punch 12 has a tapered cross-section provided with sloping surface 12*a*, 12*a* as shown in FIG. 3, the grip portion of the punch 12 being thicker than the cutter blade.

The method for providing space sections in a slide fastener chain using the above-described apparatus of the present invention is explained in the following. The fastener chain F is placed on the die 8 with the interlocking elements E upside and held by the guide member 14 as shown in FIG. 5. The placing of the slide fastener chain F on the die 8 is facilitated by lifting the guide member 14 by aid of the vertical adjustment cam 21 and then lowering the guide member 14 onto the slide fastener chain F. Then, the punch 12 is lowered to cut off the interlocking head portions H. In this case, due to the force of the lowering punch 12, the individual interlocking filaments e consisting of head portions H and leg portions L and neighbouring portions of the tapes t are made to bend into a V-shape into the recess 13 having rigid edges and provided in the upper surface of the die 8, the edges serving as a fulcrum. This bending form of the filaments e or the leg portions L and the tapes t is maintained as such after the head portions H have been cut off, as shown in FIG. 8.

Figure 7:
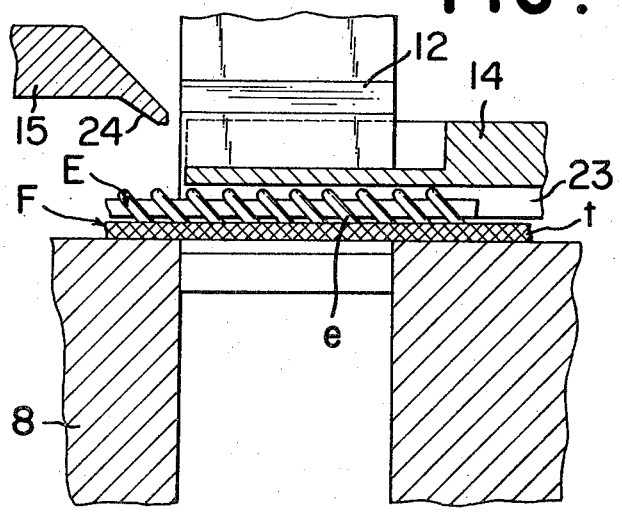

On the other hand, the scraper 15 fixed to the scraper holder 19 also moves downwardly as engaged with the support 16. When the scraper holder 19 comes to its lower position and is brought into contact with the inclination cam 26 at the sloped surface 25, the scraper 15 moves downwardly aslant as the scraper holder 19 slides along the sloped surface 25 of the inclination cam 26. Consequently, as is shown in FIGS. 7 and 9, the tips of the claws 24 of the scraper 15 move along the arrow 27 and then enter into the looped leg portions of the filaments e to pick off the leg portions L after the head portions H have been completely cut off.

Figure 11:
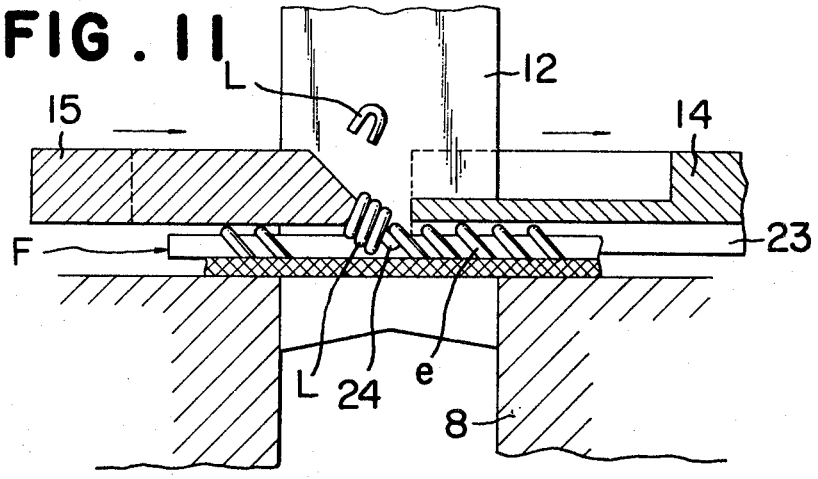

As is shown in FIGS. 9 and 11, the guide member 14 also moves to the forward direction along the interlocking elements E together with the scraper 15 as it moves down aslant, whereupon the piston rod 29 of the cylinder 28 is operated forwardly to push the guide member 14 and the scraper 15 forwardly, whereby the remaining leg portions L, L of the filaments e are removed successively by the tips of the claws 24 of the scraper 15. During the above movements of the guide member 14 and the scraper 15, the punch 12 stays at its lowermost position after the head portions H are cut off, while the remaining leg portions L are kept as pressed downwardly by the tapering surfaces 12*a*, 12*a* of the punch 12, so that the outer ends of the leg portions L are kept raised above the surface of the tapes t and the picking operation of the scraper 15 is facilitated.

A space section S is thus formed, and then the piston rod 29, the guide holder 18 and the guide member 14 as well as the scraper holder 15 are retracted to their respective original positions by the pulling force of the spring 30. At the same time, the movable bench 10 is elevated together with the punch 12 to return to their original uppermost positions.

As is described in the foregoing, the preferred method for providing space sections in a continuous slide fastener chain of the coiled plastic filament type according to the present invention includes the steps of holding the slide fastener chain on a die, cutting off the head portions of the plastic filament coils with a punch and picking off the remaining debris, i.e. the leg portions. The step of holding the slide fastener chain on the die is operated such that the interlocking filament coils become inclined as pressed downwardly by the cutter blade of the punch, thereby to automatically and simultaneously widen the gap between a pair of tapes to which the interlocking elements are attached. Thus, a particular step of providing a wide longitudinal gap between the a paired tapes, which has been indispensable in the prior art techniques, can be dispensed with in the method of the present invention and, as such, the speeding up of the manufacturing process as well as improvement in process efficiency can be attained.

The illustrated apparatus according to the present invention, on the other side, comprises a guide member 14 for holding the slide fastener chain, a die 8, a punch 12 for cutting off the interlocking head portions H and a scraper 15 for removing the remaining leg portions L, each in close linkage motion with the other. In the apparatus, as described above, there is no necessity for any particular means, for example, a clipper, to provide a wide gap between the paired tapes. This contributes to a great simplification of the apparatus. Further, the process efficiency is largely enhanced due to the removal of the leg portions L which is carried out by the movement of the scraper 15 along the interlocking elements E in synchronization with the guide member when the punch 12 is at its lowermost position directly succeeding the cutting step. Furthermore, the removal of the leg portions L is very much facilitated due to the operation of the scraper 15 which takes place as the leg portions L are kept raised above the surface of the tapes t while the cutting punch 12 stays at its lowermost position, thus minimizing the possibility of leaving any of the leg portions L unpicked and offering great reliability of the process.

We claim:

1. A method for providing a space section in a slide fastener chain of the coiled plastic filament type in which the chain is stitched to a fastener tape with head portions at the edge of the tape and leg portions remote from the edge of the tape, which method comprises the steps of:

(a) supporting the slide fastener chain on the tape side thereof and adjacent the leg portions, (b) lowering a punch having a cutter blade towards the head portions of the supported slide fastener chain, whereby the chain becomes inclined with the head portions exposed, (c) cutting off the head portions of the chain by the cutter blade while the chain is kept in the inclined position, and (d) removing the leg portions of the interlocking elements.

2. An apparatus for providing a space section in an assembled slide fastener chain of the type having a pair of interlocked continuously coiled plastic filaments stitched to respective fastener tapes along the edges thereof each chain having head portions at the edge of its respective tape for interlocking with the other chain and leg portions remote from the edge of the tape comprising:

(1) a fastener-supporting die facing a punch having a cutter blade said die being provided with a recess smaller in width than the total width of the interlocked filaments of the slide fastener chain and into which the head portions of the chain move as inclined upon contact by the cutter blade upon the downward pressing of the punch, (2) a guide member above the die, supported by a guide holder to hold the interlocking elements together with the die underneath and capable of moving transversely of the axis of the punch along the row of the interlocking elements, (3) a scraper positioned above the die to pick off the leg portions of the chain after the head portions have been cut off by the cutter blade of the punch, while the punch is staying at its lowermost position, and (4) a means for moving the guide member and the scraper in a synchronized motion when the punch is at the lowermost position.

3. The apparatus as claimed in claim 2 wherein the punch has tapered surfaces between its lower cutting end and the portion at which the cutter blade is operated, whereby the interlocking elements are forcibly pressed downwardly into the recess of the die.

4. The apparatus as claimed in claim 2 wherein the scraper is fixed to a scraper holder movable in the vertical direction and in the direction parallel to the interlocking elements in synchronization with the punch and the guide member, and an inclination cam is provided within the track of the vertical movement of the scraper holder having a sloping surface along which the scraper holder slides down aslant, whereby the tips of the scraper enter between the leg portions of the elements at the same angle as the angle of inclination of the leg portions at the raised position.

* * * * *